United States Patent [19]

Cronk, Jr. et al.

[11] Patent Number: 4,948,299

[45] Date of Patent: Aug. 14, 1990

[54] PADDING MACHINE

[76] Inventors: Thomas J. Cronk, Jr.; Ronnie C. Burrows, both of P.O. Box 11189, Odessa, Tex. 79760

[21] Appl. No.: 350,011

[22] Filed: May 9, 1989

[51] Int. Cl.[5] ..... E02F 1/00; B07B 9/02

[52] U.S. Cl. ..... 405/179; 405/174; 37/142.5; 198/522; 209/421; 209/234

[58] Field of Search ..... 37/142.5, 99, 103; 405/179, 174; 198/508, 520, 522; 209/234, 235, 236, 421

[56] References Cited

U.S. PATENT DOCUMENTS

| | | | |
|---|---|---|---|
| 3,701,422 | 10/1972 | Downey | 37/142.5 X |
| 4,377,365 | 3/1983 | Layh | 37/142.5 X |
| 4,633,602 | 1/1987 | Layh et al. | 37/142.5 X |
| 4,640,364 | 2/1987 | Theurer | 209/421 X |
| 4,789,068 | 12/1988 | Gilmore | 209/234 X |
| 4,812,078 | 3/1989 | Rivard | 405/179 |

*Primary Examiner*—Dennis L. Taylor
*Assistant Examiner*—J. Russell McBee
*Attorney, Agent, or Firm*—Vaden, Eickenroht, Thompson & Boulware

[57] ABSTRACT

There are disclosed two embodiments of a pipeline padding machine which comprises a first rearwardly inclined conveyor mounted on a vehicle adapted to be moved along a ditch in which a pipeline has been laid and over a row of spoil which has been removed from the ditch, and a scoop on the forward end of the first conveyor for removing a layer of the spoil and delivering it onto the first conveyor as the vehicle moves over the row of spoil. The first conveyor is arranged to move the spoil rearwardly and thus onto a second screen at its rearward end having means for moving that portion of the spoil which does not pass it in a rearward direction. A second conveyor mounted on the vehicle beneath the screen for receiving spoil which passes it and moving the spoil toward one end of the second conveyor, and a third conveyor is mounted on the vehicle for receiving spoil from the end of the second conveyor and extending laterally of the vehicle for moving that spoil into the ditch and over the pipeline.

23 Claims, 5 Drawing Sheets

PADDING MACHINE

This invention relates generally to machines for covering a pipeline which is laid in a ditch with padding. More particularly, it relates to improvements in machines of this type in which a vehicle moves over a row of the spoil from the ditch along one side thereof in order to pick up a portion of the spoil and deliver it onto a screen to separate rocks and other large solid particles therefrom, and then return the spoil or padding which passes the screen to the ditch for covering the pipeline, before the ditch is filled by the remaining spoil, and thereby protect it from damage by such particles.

U.S. Pat. Nos. 3,701,422 and 4,633,602 show machines of this general type wherein a longitudinally extending, rearwardly inclined conveyor is mounted on the vehicle to receive a portion of the spoil from the row on its lower forward end and deliver it to a screen at its upper rearward end. More particularly, a laterally extending conveyor is arranged beneath the screen to receive spoil which passes the screen and deliver it to the ditch to cover the pipeline, with the portions of the spoil which do not pass the screen falling to the side of the ditch behind the vehicle and thus in a position to be later moved into the ditch over the padding.

One problem with these and similar machines is that they do not permit recovery of enough padding from the spoil, i.e., much of the padding is merely returned to the side of the ditch. A larger screen may not be a viable alternative because, for one thing, there are width and height limitations on any machine which must traverse a public highway. On the other hand, increasing the length of the screen increases the overall length of the machine, which in many cases, is already too long for ease of operation.

The primary object of this invention therefore is to provide a machine of this type which is able to recover more padding without substantial increased in the size, and further which is of relatively simple and inexpensive construction.

These and other objects are accomplished, in accordance with the illustrated embodiments of the present invention, by a pipeline padding machine of the type described comprising a scoop at the forward end of a first, rearwardly inclined conveyor for removing a layer of the spoil along the side of the ditch and delivering it onto the conveyor during forward movement of the vehicle, the first conveyor being arranged to move the spoil in a rearward direction and onto means including a rearwardly inclined screen at the rearward end of the first conveyor for moving that portion of the spoil which does not pass the screen in a rearward direction for laying along the side of the ditch rearwardly of the vehicle. More particularly, a second conveyor which is mounted on and extends lengthwise of the vehicle beneath the first screen for receiving spoil which passes therethrough is arranged to move it toward one end of the second conveyor, and a third conveyor is mounted on the vehicle for receiving spoil from the one end of the second conveyor and extends laterally of the vehicle for moving the spoil thereon in a lateral direction into the ditch.

In accordance with the preferred and illustrated embodiments of the invention, the screen comprises a continuous belt having screen sections arranged to form a top flight over which the unscreened spoil is moved and a bottom flight having open spaces to permit spoil which passes the top flight to drop freely onto the second conveyor. More particularly, one end edge of each screen section is pivotally connected to an endless chain for swinging about a laterally extending axis between a position in which it is supported by the belt with its opposite end edge near one end of the adjacent section, when traversing the top flight, and a position in which it depends from the chain to open a space between its one edge and that of the adjacent section, while traversing the bottom flight. One edge of each screen section is pivotally mounted on pins which connect the links of laterally spaced chains, with adjacent screen sections being connected to alternate pins and supported by intermediate pins along the top flight.

In accordance with one illustrated embodiment of the invention, the machine also includes a forwardly inclined second screen which is arranged to receive spoil which is moved over the rear end of the first screen and move that portion of the spoil which does not pass the second screen onto the side of the ditch behind the vehicle, and the second conveyor is arranged to move spoil which passes the first screen in a rearward direction. More particularly, a third conveyor is mounted on the vehicle for receiving spoil from the rearward end of the second conveyor as well as that spoil which passes the second screen and extends laterally of the vehicle for moving the accumulation of the spoil in a lateral direction into the ditch.

As illustrated, means are provided for pivotally connecting the rearward end of the first screen to the forward end of the second screen, together with means for raising and lowering their connected ends, thus simultaneously increasing or decreasing the extent of inclination of both screens.

In accordance with another embodiment of the present invention, the second conveyor is arranged to move spoil which passes the first screen in a forward direction, and the third conveyor is mounted on the vehicle at the forward end of the second conveyor for receiving spoil therefrom in order to move it into the ditch. In the drawings wherein like reference characters are used throughout to indicate like parts:

FIG. 1 is a side view and FIG. 2 is a top plan view of a pipeline padding machine constructed in accordance with the first described embodiment of the invention, with the vehicle shown as it moved forwardly along the side of the ditch in which a pipeline is laid so as to remove a layer of the spoil and deliver it onto screens which separate rocks and other large solid particles therefrom and return the padding, or that portion of the spoil which passes the screens, to the ditch for covering the pipeline while depositing spoil which does not pass either of screens onto the side of the ditch behind the vehicle;

Figure 8:
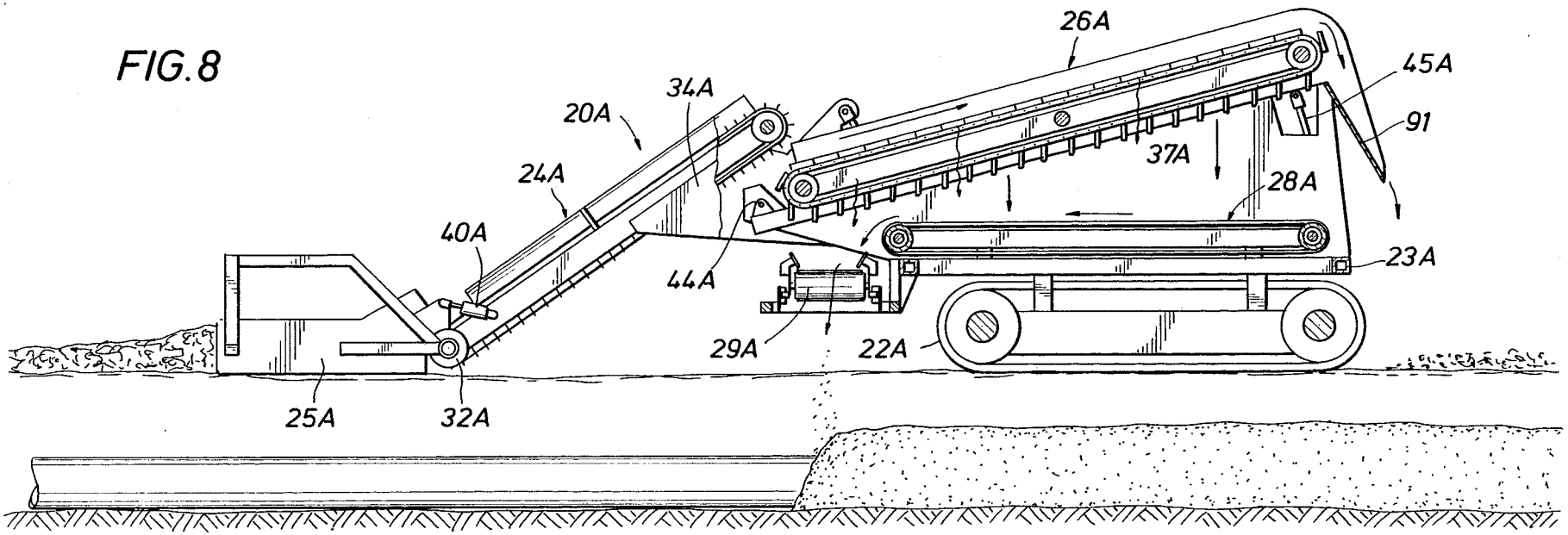
Figure 9:
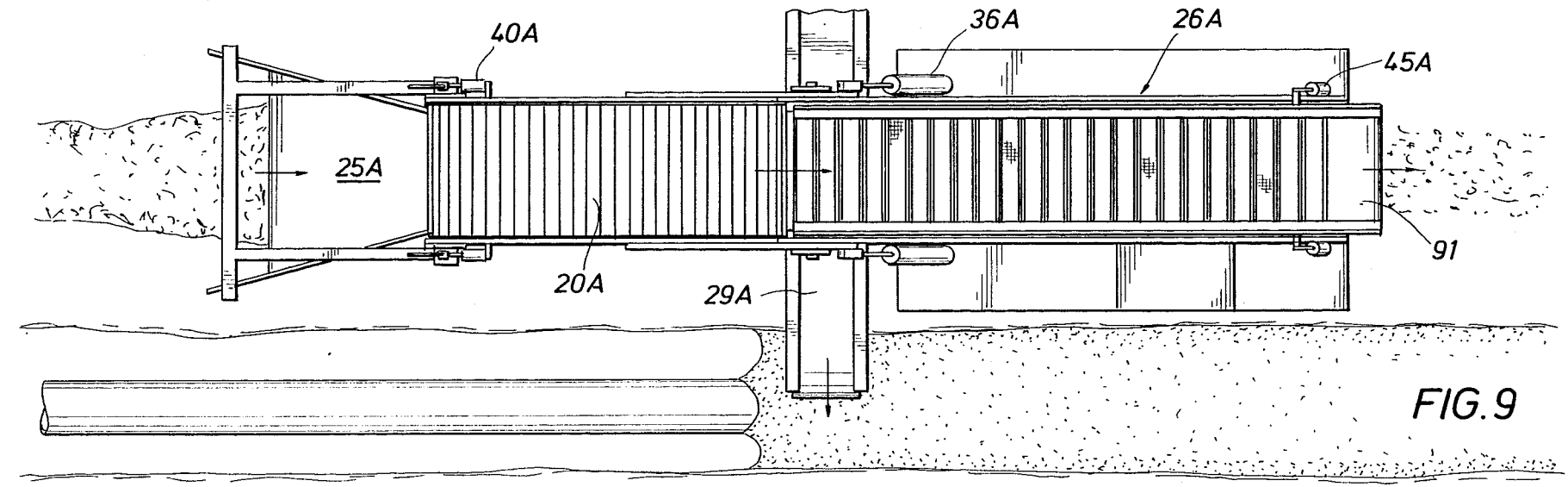

FIG. 8 and 9 are side and top plan views of a pipeline padding machine constructed in accordance with the second described embodiment of the present invention, also showing the machine as it moves forwardly along the side of a ditch in which the pipeline has been laid, so as to remove a layer of the spoil for screening and return that portion which passes the screen to the pipeline in the ditch while dumping the remainder onto the side of the ditch behind the machine.

Figure 1:
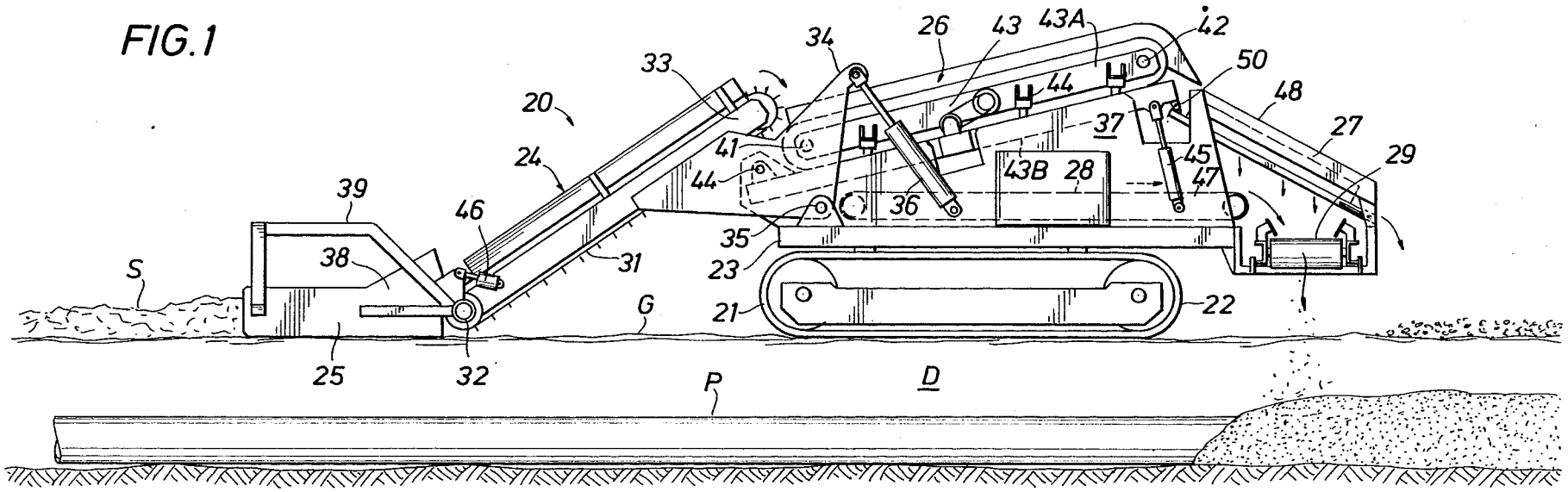
Figure 2:
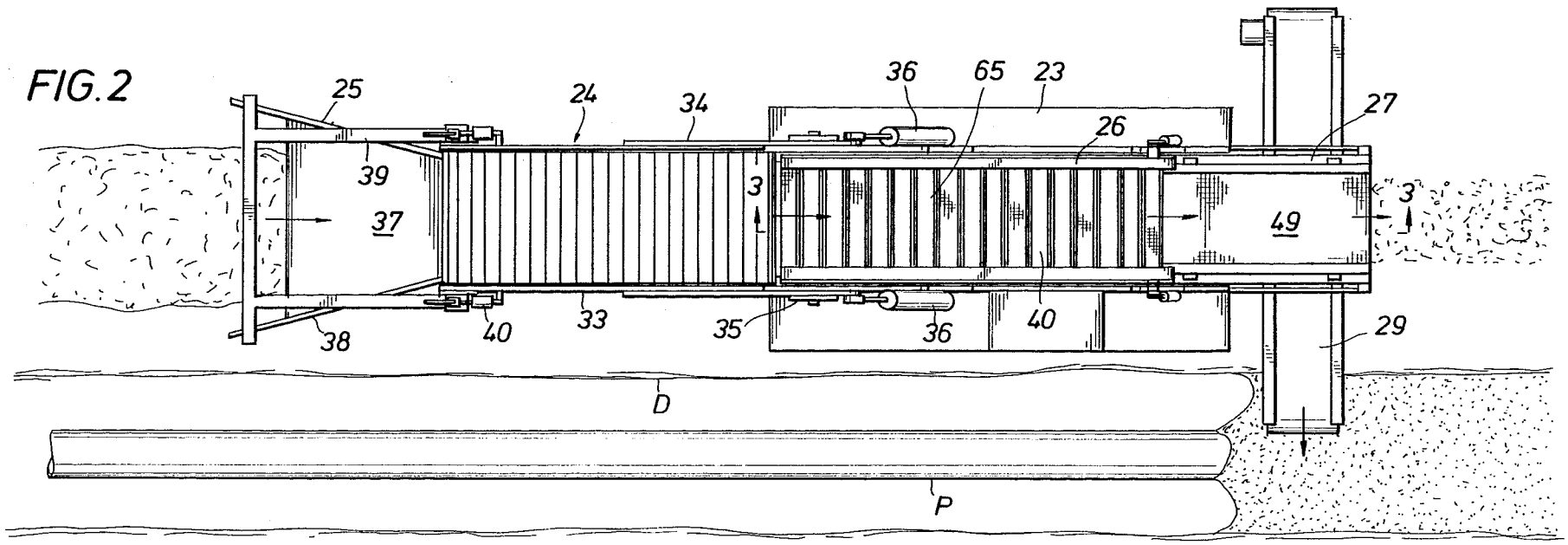

With reference now to the details of the above described drawings, and particularly the embodiment of FIGS. 1 and 2, the overall machine, which is indicated in its entirety by reference character 20, includes a vehicle 21 which is adapted to be moved forwardly over the ground G along the side of a ditch D in which a pipeline P has been laid and over a row of spoil S which has been removed from and laid along the side of the ditch. The vehicle is shown to have crawlers 22 on which a platform 23 is supported for carrying the conveyors, screen and other parts of the machine along with the vehicle. As previously mentioned, and as shown in FIGS. 1 and 2, the machine is adapted to remove a layer of the spoil and screen it, as it continues to be moved forwardly along the side of the ditch, so as to separate rocks and other large solid particles from the spoil, and then deliver the portion of the spoil or padding which passes the screen back into the ditch and over the pipeline P while dumping the unscreened portion of the spoil onto the ground G along the side of the ditch and rearwardly of the machine.

As previously described, the machine also includes a first conveyor 24 which is mounted on the vehicle for extension lengthwise thereof, and a scoop 25 at the forward end of the first conveyor for removing a layer of this spoil S and delivering it onto the forward end of the first conveyor during continued forward movement of the vehicle. As shown, the conveyor is inclined upwardly from its forward to its rearward end and, as indicated by the arrows in FIG. 1, is arranged to move the spoil in a rearward direction onto a first rearwardly inclined screen 26 having its front end arranged beneath rearward end of the first conveyor. As will be described to follow, the screen is of such construction that the portion of the spoil which does not pass through it is moved rearwardly thereover onto a second screen 27 having its forward end mounted on the machine at the rearward end of the first screen. The second screen is forwardly inclined so that the portion of the spoil which does not pass the second screen is moved over the rear end of the second screen and onto the side of the ditch behind the vehicle.

A second conveyor 28 is mounted on and extends lengthwise of the vehicle beneath the first screen 26 for receiving spoil which passes through the first screen; and is arranged to move the spoil in a rearward direction. A third conveyor 29 is mounted on the vehicle rearwardly of the second conveyor and beneath the second screen 27 for receiving spoil from the rearward end of the second conveyor as well as spoil which passes through the second screen. More particularly, this third conveyor extends laterally of the vehicle and is arranged to move the accumulation of spoil from the second screen and the second conveyor in a lateral direction back into the ditch so as to provide the padding for covering the pipeline, as shown in FIGS. 1 and 2.

The portion of the spoil which has not passed either of the first and second screens, and which is dumped onto the ground behind the vehicle is adapted to be subsequently moved by trailing apparatus into the ditch so as to cover the padding over the pipeline, the padding thus serving to isolate the pipeline from the rocks or other large particles in the unscreened spoil which then fills the ditch.

The conveyor 24 is of conventional construction comprising an endless belt 31 driven by shafts 32 at each end mounted on side walls 33 and arranged to move its top flight in a rearward direction. The side walls are fixed to plates 34 which are pivotally mounted on trunnions on the platform 23 of the vehicle by means of pins 35 to support the conveyor with its forward end in front of the crawlers and its rearward end above its forward end. A hydraulic actuator 36 extends between side walls 37 on the platform and the upper right hand end of the plate 34, so that the conveyor may be swung about the axis of the pin 35 to raise or lower its front end and thus adjust its inclination.

The scoop 25 comprises a blade 37 which extends horizontally between side walls 38 and has a front cutting edge which removes a layer of the spoil S as it moves forwardly therealong. The sidewalls 38 converge toward their rearward ends to deliver the removed layer of spoil onto the forward end of the conveyor 24.

The side walls 38 of the scoop are mounted on a frame 39 having a rearward end which is pivotally mounted on the forward shaft 32 of the conveyor 24. More particularly, hydraulic actuators 40 are connected between the side wall 33 of the conveyor and trunnions on the frame so as to permit the rearward end of the scoop to be swung about the laterally extending axis of the shaft with respect to the forward end of the conveyor. The combined operation of the actuators 36 and 40 permits the forward end of the first conveyor and the scoop to be raised or lowered so as to adjust the elevation of the forward edge of the blade 37.

The screen 26 comprises a continuous belt 40 of screen sections mounted on shafts 41 and 42 supported by sidewalls 43, which are in turn supported by brackets 43A on a subframe 43B. As shown, the forward end of the screen is just below the rearward end of the first conveyor 24 so as to receive spoil therefrom, and as will be described in more detail to follow, the screen comprises sections which are adapted to form a top flight having a support surface arranged to move portions of the spoil which do not pass the screen over the rearward end of the screen, and a bottom flight which is so arranged so as to permit the spoil which passes the top flight of the screen to pass freely therethrough.

The forward end of subframe 43B is pivotally connected at 44 to the side plates 37 of the vehicle platform and its rearward end is supported by a hydraulic actuator 45 extending between its rearward end and the side plates of the vehicle. Thus, the rearward end of the screen 26 may be raised or lowered to adjust its inclination.

The second conveyor 28 disposed beneath the first screen 26 and extending lengthwise of the vehicle is also of conventional construction comprising a continuous belt 47 mounted on shafts 47A and 47B at its opposite end. The shafts are supported by side walls mounted on the vehicle platforms and the belt is arranged with its top flight disposed to receive spoil which passes the first screen 26 and move it in a rearwardly direction.

Figure 3:
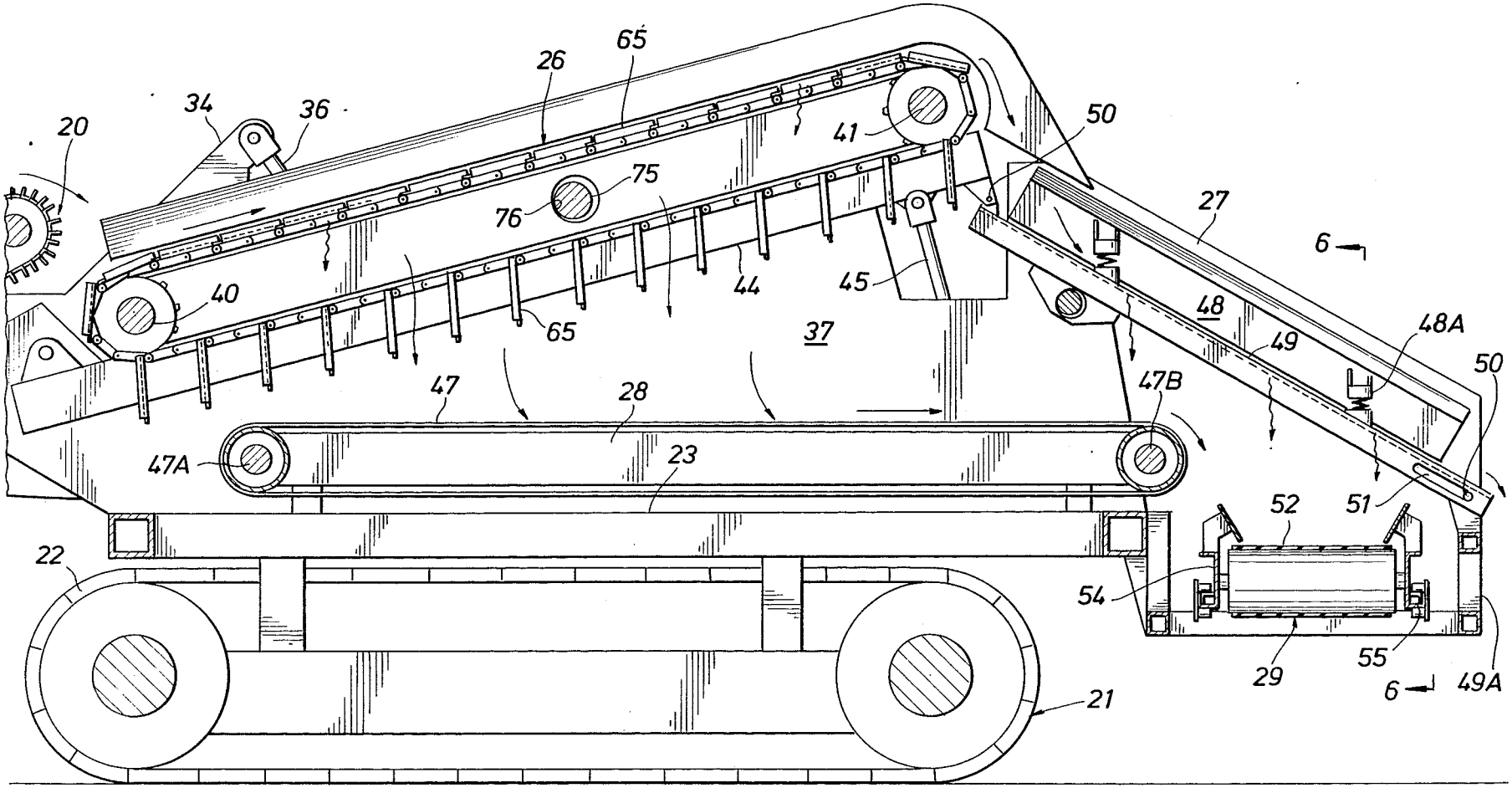
FIG. 3 is an enlarged longitudinal sectional view of the portion of the machine rearwardly of its first conveyor, as seen along broken lines 3—3 of FIG. 2.

The second screen 27, on the other hand, includes a screening surface 49 which extends between side walls 48 having brackets 48A supported on a subframe 49. As best shown in FIG. 3, the forward end of the subframe is connected by a pivot pin 50 to the rearward end of the subframe 44 of the first screen, and the rearward end thereof is supported on a rearward extension 49 of the platform 23 of the vehicle. More particularly, slots 51 are formed in the side walls of the subframe of the second screen for sliding over pins 50 on opposite sides of the platform extension so as to permit the forward end of the screen to be moved either forwardly or rearwardly with respect to the vehicle as it is raised and lowered by the actuator 45 connected to the rear end of the first screen. As shown, the upper end of the second screen is disposed beneath the rear end of the first screen so as to receive spoil which does not pass the first screen and extends downwardly and rearwardly so as to cause the spoil to move over its surface and onto the ground to the rear end of the vehicle.

The third conveyor 29 comprises a continuous belt 52 disposed about shafts 53 at its opposite end which are supported by side walls 54. More particularly, the side walls are supported on the platform extention 49A to the rearward end of the second conveyor 28 and beneath the second screen 27. Thus, as previously described, spoil which has passed the second screen as well as spoil which has passed the first screen is received on the third conveyor 29 for movement laterally thereover and into the ditch over the pipeline P. The shafts of the conveyor are reversible to permit the top flight of the conveyor belt to move in either lateral direction, depending on the location of the vehicle with respect to the ditch.

As best shown in FIG. 1, the opposite ends of the conveyor extend laterally to each side of the vehicle to the extent necessary to move the spoil padding into the ditch. The conveyor is adjustable laterally with respect to the vehicle to permit its opposite ends to be extended in either direction as needed. For this purpose, beams 55 on the outer sides of the walls 54 of the third conveyor are guidably movable between rollers 56 and 57 mounted on brackets 58 on the platform extension. As also shown, confining walls 60 are mounted on brackets 61 at the upper end of each sidewall and extend downwardly and inwardly across the top of the belt to confine spoil which moves onto and over its top flight. Flexible strips 62 extend between the lower edges of the confining walls 60 and the top flight of the belt to close the gap between them.

As previously described, and as best shown in FIGS. 2, 3, 4, and 5, the endless belt 40 of the first screen 26 is made up of a plurality of screen sections 65 which are pivotally connected at each side to chains 66 which surrounds sprockets on the shafts 41 and 42 at each end of the side walls 43 of the screen. More particularly, the screen sections are so supported on the chains that, when traversing the upper flight of the belt, they assume relatively horizontal positions in which they are supported on the chain with their end edges substantially adjacent to one another. Thus, they provide a substantially continuous screen surface arranged, upon movement of the top flight of the chain in a rearward direction, to carry the unscreened rocks and other large particles upwardly and over the rear end of the screen. On the other hand, the pivotal connections of the screen sections to the chain permit them to assume a substantially vertical position along the bottom flight of the chain, thereby opening spaces between the pivotal connections of the screen sections which are substantially unobstructed so as to permit the spoil which passes the top flight to fall freely therethrough onto the second conveyor 28.

Since the screen moves unscreened portions of the spoil past its upper rearward end and onto the second screen, it's not necessary that it be capable of screening all of the spoil which it receives from the first conveyor. Thus, the remainder of the spoil to be recovered as padding will pass through the second screen 27. Preferably, the second screen has a larger mesh than the first screen so as to pass larger particles than are passed by the first screen, those particles not passing the second screen being dropped off the lower rearward end of the second screen, as previously mentioned.

More particularly, each of the screen sections is pivotably connected at its opposite sides to the chains of the endless belt by means of sleeves 66A connected to the lower side of each chain section adjacent to the bottom of each side thereof, and received over a pin 67 extending inwardly from the inner side of the chain. The free ends of the screen section have pins which are supported by the chain in a generally horizontal position as they screen sections traverse the top flight of the belt, and lie substantially adjacent the pivoted ends of the adjacent sections along the top flight of the belt so that each chain section spans substantially the entire distance between every other pivot pin 66.

Figure 4:
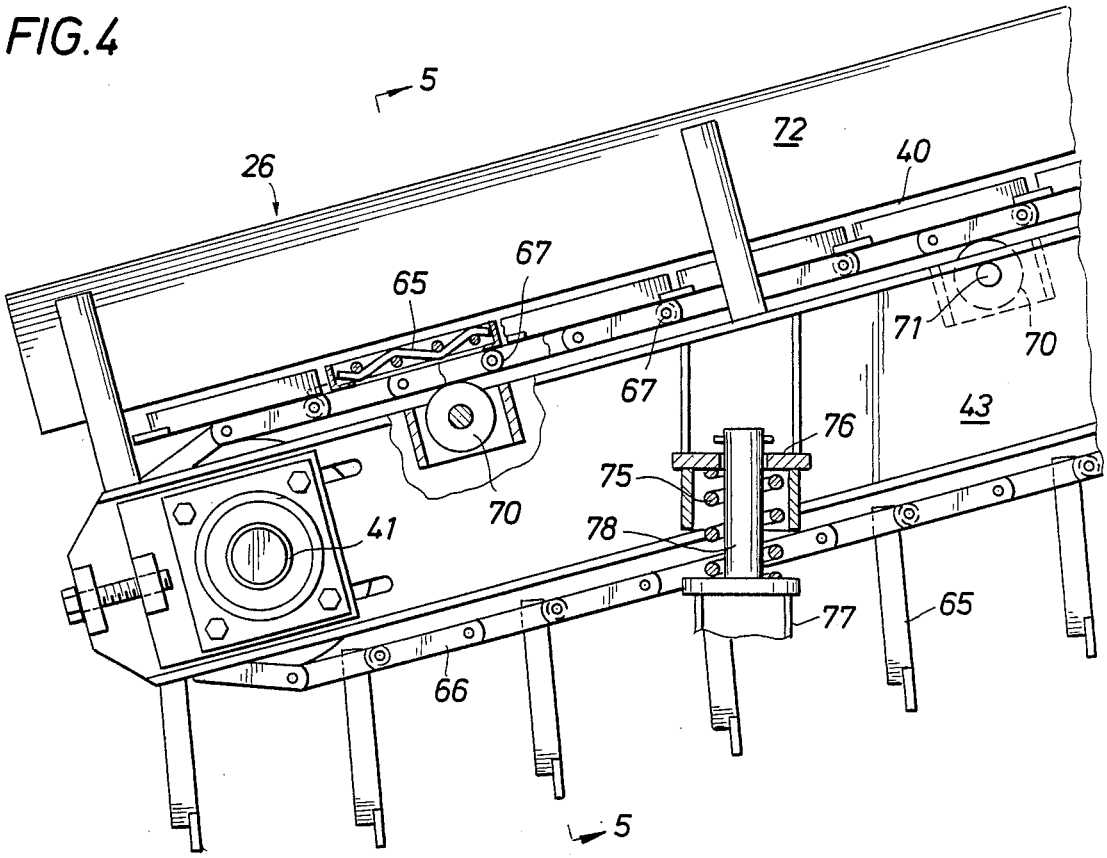
FIG. 4 is a further enlarged sectional view of a portion of the forward end of the first screen of the machine.
Figure 5:
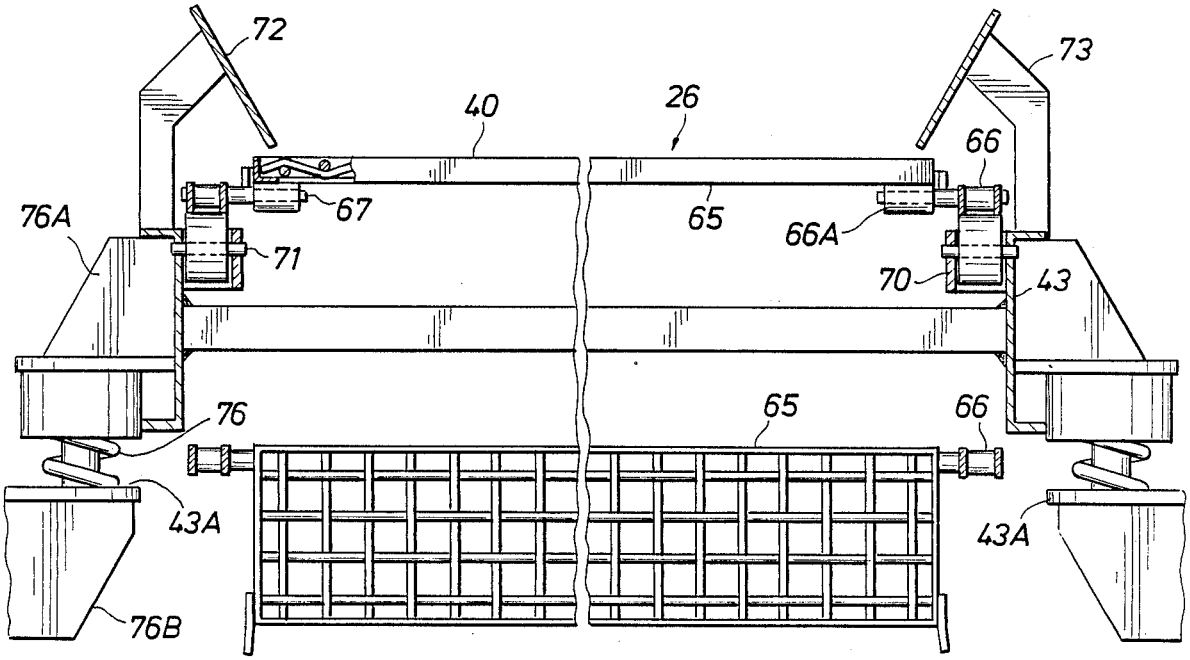
FIG. 5 is a cross-sectional view of the first screen, as seen along broken lines 5—5 of FIG. 4.

The chain is held taughtly by a longitudinal adjustment of one of the shafts relative to the support walls 43, as shown in FIG. 4. Intermediate portions of the top flight of the belt are supported by rollers 70 mounted on shaft 71 received within brackets on the side walls 43 of the screen.

As also shown, confining walls 72 are mounted on brackets supported on the side walls of the subframe along each side of the top flight of the belt, thus preventing spoil moving along the top flight from spilling over the sides of the belt. The rearward ends of these confining walls extend beyond and curved over the rear ends of the screen 26 so as to continue to confine the spoil as it falls from the upper end of the screen 26 onto the screen 27.

As previously described, means are provided for adjusting inclination of each of the screens and thus the effective widths of the screen openings, which in turn controls the size of particles which are permitted to pass therethrough. Thus, the rearward end of the first screen 26 and the forward end of the second screen 27 may be raised and lowered by the hydraulic actuator 45.

It is also preferred that each of the screens be provided with means for vibrating it so as to further enhance the separation of the smaller particles from the spoil, and thus to permit more thorough screening of the same. For this purpose, a shaft 75 mounted on opposite ends of the subframe of the first screen has an eccentric 76 which extends through holes in the side walls of the screen. Thus, upon rotation of the shaft, the side walls 43 and thus the belt is caused to vibrate because of its relative movement both vertically and longitudinally with respect to the frame 44.

These side walls of the screen are supported on its subframe by coil springs 76 disposed between brackets 76A on the side walls 43 and 67B on the subframe 43A. These springs thus cushion the rise and fall of the screen with respect to the subframe as it is vibrated by rotation of the eccentric shaft 75. Preferably, there are several such springs disposed in longitudinally spaced relation along each side of the belt.

Figure 6:
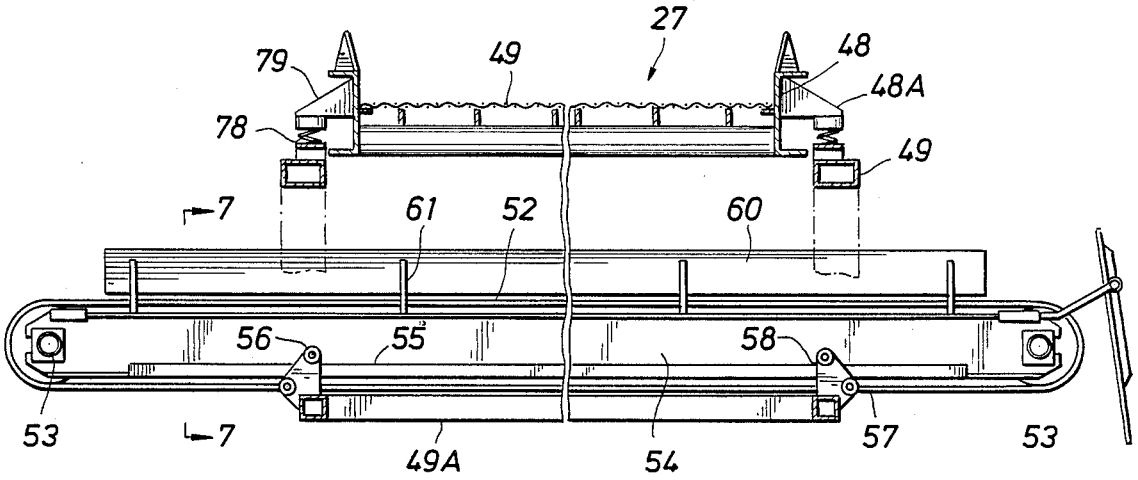
FIG. 6 is a cross-sectional view of the rearward end of the machine, including the second screen and lateral conveyor, as seen along broken lines 6—6 of FIG. 3.
Figure 7:
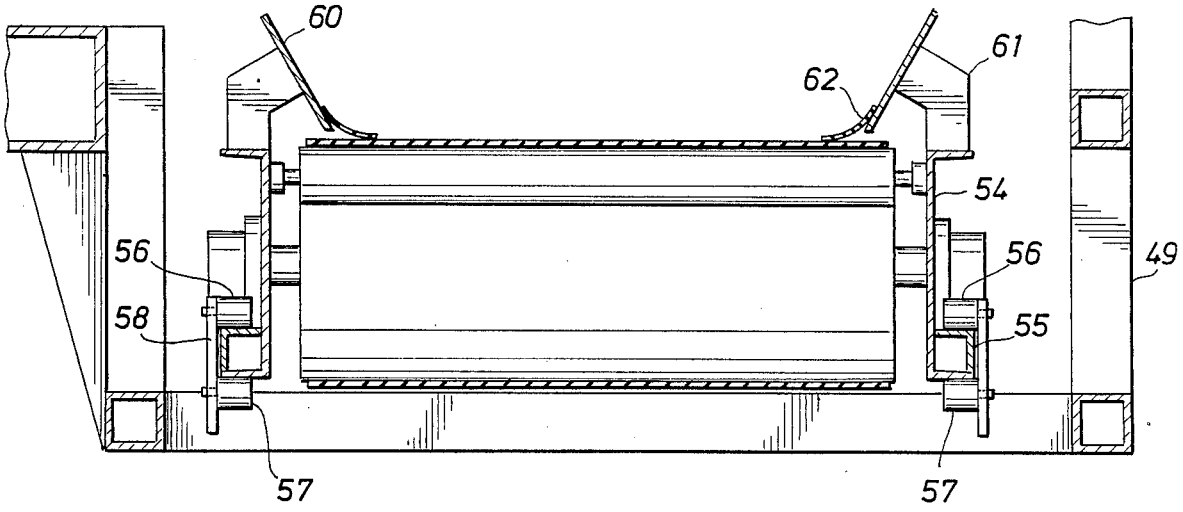
FIG. 7 is a cross-sectional view of the lateral conveyor of the machine, on an enlarged scale, and as seen along broken lines 7—7 of FIG. 6.

As best shown in FIG. 6, the side walls 48 of the second screen are mounted on the platform extension 49A by means of coil springs 78 disposed between brackets on the side walls on each side of the screen body and the subframe. Thus, the screen is able to vibrate under the weight of the spoil as it falls onto the screen.

As the smaller particles of the spoil falling onto the second screen pass through it, the larger particles move downwardly along its rearwardly inclined surface and onto the ground to the side of the ditch behind the vehicle, as previously described. Walls extend upwardly from the second screen surface along its opposite sides so as to confine the spoil moving therealong.

Many of the components of the second embodiment of the machine, which is shown in FIGS. 8 and 9 and indicated in its entirety by the reference character 20A, correspond to those of the first machine 20. Hence, the corresponding parts are indicated by the same reference characters, with the exception of the addition of the suffix "A". As a result, the manufacturer of the machines may be able to interchange parts between the two of them, thus selecting whichever embodiment of the machine best suits the user.

Thus, for example, the machine 20A includes a first upwardly and rearwardly inclined conveyor 24A, and a scoop 25A disposed on the forward end of the conveyor and pivotally connected thereto by pin 32A. In addition, an hydraulic actuator 40A is connected between the first conveyor 24 and the scoop 25A so as to permit adjustment of their angular disposal with respect to one another. Furthermore, the upper end of the first conveyor is mounted on side plates 34A which are pivotally connected to trunnions mounted on the platform 23A of the vehicle 22A, and an hydraulic actuator 36A extends between the side walls of the platform and the upper right hand corner of the plate 34A, whereby the actuators 36A and 40A may be adjusted, as described in connection with the first machine 20, so as to not only adjust the inclination of the first conveyor, but also raise or lower the cutting edge of the scoop 25A, thereby enabling a layer of spoil S of desired depth to be removed from the row of spoil S and moved onto the first conveyor.

The machine 20A also includes a first screen 26A of a construction similar to the screen 26 of the machine 20, as well as a second conveyor 28A mounted on the frame of the vehicle beneath the screen 26A and of a construction similar to conveyor 28 of the machine 20. The screen 26A functions in substantially the same way as the screen 26, thus permitting particles of the spoil which pass through the top flight of its screen sections to fall freely onto the second conveyor 28A.

In the case of the machine 20A, however, the belt of conveyor 28A is so arranged as to cause its top flight to move forwardly, and thus to move the spoil which passes through the screen 26A to move toward the forward end of the machine. Thus, in this case, a laterally extending conveyor 29A corresponding generally to the lateral conveyor 29 is mounted on a forward extension of the platform 23A of the machine, rather than at its rearward end, thus disposing the lateral conveyor 29A in a position to receive a spoil which moves forwardly over the top flight of the second conveyor 28A. As in the case of the machine 20, the lateral conveyor 29A is adapted to move spoil which is received thereon back into the ditch to provide padding for the top of the pipeline in the ditch, as shown in FIGS. 8 and 9.

The spoil which does not pass the screen 26A falls over the rearward end of the screen and thus onto the ground to one side of the ditch behind the vehicle. To facilitate this, the confining walls on opposite sides of the screen may extend downwardly a substantial distance on opposite sides of a bottom wall 91 to deflect the spoil beyond the rear of the vehicle. It is also contemplated that the screen 26A may be of somewhat greater length than the screen 26A or that the second conveyor 28A may be somewhat shorter than conveyor 28, so as to accommodate the disposal of the lateral conveyor 29A at the rearward end of the second conveyor 28A.

The forward end of the screen 26A is pivotally mounted from the subframe by means of pins 44A mounted in trunnions on the top side of the subframe and having their opposite ends supported by side walls 37A of the vehicle platform. The rearward end of the screen is supported by a hydraulic actuator 45A extending between it and the sidewalls 37A, as described in connection with machine 20, thereby permitting adjustment of the inclination of the screen. The screen is so mounted as to be vibrated by means of one or more eccentric shafts as described in connection with machine 20, and further is mounted upon coil springs disposed between the body of the belt and its frame, again as previously described in connection with machine 20.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A pipeline padding machine, comprising a vehicle adapted to be moved along the side of a ditch in which a pipeline has been laid and over spoil which has been removed from the ditch and laid along the side thereof, a first conveyor which is mounted on and extends lengthwise of the vehicle, means at the forward end of the first conveyor for removing a layer of the spoil and delivering it onto the first conveyor during forward movement of the vehicle, said first conveyor being inclined upwardly from its forward to its rearward end and arranged to move the spoil in a rearward direction, means including a first screen for receiving spoil from the first conveyor and moving that portion of the spoil which does not pass the first screen over the rear end of the first screen, said first screen being rearwardly inclined, a second screen arranged to receive spoil which is moved over the rear end of the first screen and being forwardly inclined so as to move that portion of the spoil which does not pass the second screen onto the side of the ditch behind the vehicle, a second conveyor which is mounted on and extends lengthwise of the vehicle beneath the first screen for receiving spoil which passes therethrough and arranged to move it in a rearward direction, and a third conveyor mounted on the vehicle for receiving spoil from the rearward end of the second conveyor as well as that which passes the second screen and extending laterally of the vehicle for moving said accumulation of spoil in a lateral direction into the ditch.

2. A machine of the character defined in claim 1, wherein the first screen comprises a continuous belt having screen sections arranged to form a top flight over which the unscreened spoil is moved and a bottom flight having open spaces to permit spoil which passes the top flight to drop onto the second conveyor.

3. A machine of the character defined in claim 1, including means for vibrating the screens.

4. A machine of the character defined in claim 1, including means pivotally connecting the rearward end of the first screen to the forward end of the second screen, and means for raising or lowering their connected ends.

5. A machine of the character defined in claim 1, wherein the means for removing and delivering a layer of spoil comprises a scoop having a forwardly facing front cutting edge and pivotally connected to the forward end of the first conveyor, and the first conveyor is mounted on the vehicle for swinging about an axis rearwardly of its pivotal connection to the scoop.

6. A pipeline padding machine, comprising a vehicle adapted to be moved along the side of a ditch in which a pipeline has been laid and over spoil which has been removed from the ditch and laid along the side thereof, a first conveyor which is mounted on and extends lengthwise of the vehicle, means at the forward end of the first conveyor for removing a layer of the spoil and delivering it onto the first conveyor during forward movement of the vehicle, said first conveyor being inclined upwardly from its forward to its rearward end and arranged to move the spoil in a rearward direction, means including a rearwardly inclined screen arranged for receiving spoil from the first conveyor and moving that portion of the spoil which does not pass the screen over the rear end of the screen, a second conveyor which is mounted on and extends lengthwise of the vehicle beneath the screen for receiving spoil which passes therethrough and arranged to move it in a forward direction, and a third conveyor mounted on the vehicle for receiving spoil from the forward end of the second conveyor and extending laterally of the vehicle for moving the spoil in a lateral direction into the ditch.

7. A machine of the character defined in claim 6, wherein the screen comprises a continuous belt having screen sections arranged to form a top flight over which unscreened spoil is moved and a bottom flight having open spaces to permit spoil which passes the top flight to drop onto the second conveyor.

8. A machine of the character defined in claim 6, including means for vibrating the screen.

9. A machine of the character defined in claim 6, whereas the means for removing and delivering a layer of spoil comprises a scoop having a forwardly facing front cutting edge and pivotally connected to the forward end of the first conveyor, and the first conveyor is mounted on the vehicle for swinging about an axis rearwardly of its pivotal connection to the scoop.

10. A pipeline padding machine, comprising a vehicle adapted to be moved along the side of a ditch in which a pipeline has been laid and over spoil which has been removed from the ditch and laid along the side thereof, a first conveyor which is mounted on and extends lengthwise of the vehicle, means at the forward end of the first conveyor for removing a layer of the spoil and delivering it onto the first conveyor during forward movement of the vehicle, said first conveyor being inclined upwardly from its forward to its rearward end and arranged to move the spoil in a rearward direction, means including a rearwardly inclined screen for receiving spoil from the rearward end of the first conveyor and moving that portion of the spoil which does not pass the screen in a rearward direction, a second conveyor which is mounted on and extends lengthwise of the vehicle beneath the screen for receiving spoil which passes therethrough and arranged to move it toward one end of the second conveyor, and a third conveyor mounted on the vehicle for receiving spoil from the one end of the second conveyor and extending laterally of the vehicle for moving the spoil thereon in a lateral direction into the ditch.

11. A machine of the character defined in claim 10, wherein said screen comprising a continuous belt having screen sections arranged to form a top flight over which the unscreened spoil is moved and a bottom flight having open spaces to permit spoil which passes the top flight to drop freely onto the second conveyor.

12. A machine of the character defined in claim 11, wherein one end edge of each screen section is pivotally connected to the belt for swinging about a laterally extending axis between a position in which it is supported by the belt with its opposite end edge near the one end edge of an adjacent section, when traversing the top flight, and a position in which it depends from the belt to open a space between its one edge and that of the adjacent section, when traversing the bottom flight.

13. A machine of the character defined in claim 12, wherein the belt comprises laterally spaced chains having links pivotally connected by pins, and the one edge of each screen section is pivotally mounted on a pin.

14. A machine of the character defined in claim 13, wherein the adjacent screen sections are connected to alternate pins, and are supported by intermediate pins along the top flight,

15. A machine of the character defined in claim 10, including means for vibrating the screen.

16. A machine of the character defined in claim 10, wherein the first screen comprises a frame, sprockets at each side and end of the frame, a continuous belt including chains about the sprockets at each side of the frame, and rigid screen sections connected to the chains for movement therewith and adopted to be arranged in end-to-end positions when traversing the top flight, and means for rotating the sprockets to cause the top flight to move in a rearward direction.

17. A machine of the character defined in claim 10, wherein the means for removing and delivering a layer of spoil comprises a scoop having a forwardly facing front cutting edges and pivotally connected to the forward end of the first conveyor, and the first conveyor is mounted on the vehicle for swinging about an axis rearwardly of its pivotal connection to the scoop.

18. A pipeline padding machine, comprising a vehicle adapted to be moved along the side of a ditch in which a pipeline has been laid and over spoil which has been removed from the ditch and laid along the side thereof, a first conveyor which is mounted on and extends lengthwise of the vehicle, means at the forward end of the first conveyor for removing a layer of the spoil and delivering it onto the first conveyor during forward movement of the vehicle, said first conveyor being inclined upwardly from its forward to its rearward end and arranged to move the spoil in a rearward direction, means including a screen arranged for receiving spoil from the first conveyor and moving that portion of the spoil which does not pass the screen over the rear end of the screen, a second conveyor which is mounted on and extends lengthwise of the vehicle beneath the screen for receiving spoil which passes therethrough and arranged to move it in a forward direction, and a third conveyor mounted on the vehicle for receiving spoil from the forward end of the second conveyor and extending laterally of the vehicle for moving the spoil in a lateral direction into the ditch.

19. A machine of the character defined in claim 18, wherein the screen comprises a frame, sprockets at each side and end of the frame, a continuous belt including chains about the sprockets at each side of the frame, and rigid screen sections connected to the chains for movement therewith and adopted to be arranged in end-to-end positions when traversing the top flight, and means for rotating the sprockets to cause the top flight to move in a rearward direction.

20. A machine of the character defined in claim 18, wherein the means for removing and delivering a layer of spoil comprises a scoop having a forwardly facing front cutting edge and pivotally connected to the forward end of the first conveyor, and the first conveyor is mounted on the vehicle for swinging about an axis rearwardly of its pivotal connection to the scoop.

21. A pipeline padding machine, comprising a vehicle adapted to be moved along the side of a ditch in which a pipeline has been laid and over spoil which has been removed from the ditch and laid along the side thereof, a first conveyor which is mounted on and extends lengthwise of the vehicle, means at the forward end of the first conveyor for removing a layer of the spoil and delivering it onto the first conveyor during forward movement of the vehicle, said first conveyor being inclined upwardly from its forward to its rearward end and arranged to move the spoil in a rearward direction, means including a screen for receiving spoil from the rearward end of the first conveyor and moving that portion of the spoil which does not pass the screen in a rearward direction, a second conveyor which is mounted on and extends lengthwise of the vehicle beneath the screen for receiving spoil which passes therethrough and arranged to move it toward one end of the second conveyor, and a third conveyor mounted on the vehicle for receiving spoil from the one end of the second conveyor and extending laterally of the vehicle for moving the spoil thereon in a lateral direction into the ditch.

22. A machine of the character defined in claim 21, wherein the screen comprises a frame, sprockets at each side and end of the frame, a continuous belt including chains about the sprockets at each side of the frame, and rigid screen sections connected to the chains for movement therewith and adopted to be arranged in end-to-end positions when traversing the top flight, and means for rotating the sprockets to cause the top flight to move in a rearward direction.

23. A machine of the character defined in claim 21, wherein the means for removing and delivering a layer of spoil comprises a scoop having a forwardly facing front cutting edge and pivotally connected to the forward end of the first conveyor, and the first conveyor is mounted on the vehicle for swinging about an axis rearwardly of its pivotal connection to the scoop.

* * * * *